US006244916B1

(12) United States Patent
Asakura et al.

(10) Patent No.: US 6,244,916 B1
(45) Date of Patent: Jun. 12, 2001

(54) OIL FEEDING STRUCTURE OF PERSONAL WATERCRAFT

(75) Inventors: Yukio Asakura; Takehiro Nakashima, both of Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/371,726

(22) Filed: Aug. 10, 1999

(30) Foreign Application Priority Data

Aug. 11, 1998 (JP) ..... 10-226627

(51) Int. Cl.[7] ..... B63H 21/10; B63B 35/73
(52) U.S. Cl. ..... 440/88; 114/55.53
(58) Field of Search ..... 114/55.5, 55.51, 114/55.53, 55.57; 440/88; 296/97.22

(56) References Cited

U.S. PATENT DOCUMENTS 4,640,126 * 2/1987 Jansch ..... 73/290
5,390,621 * 2/1995 Hattori et al. ..... 114/55.51
5,537,948 * 7/1996 Kobayashi ..... 114/55.57
5,586,922 * 12/1996 Kobayashi et al. ..... 440/88
5,669,326 * 9/1997 Ikeda ..... 114/363
5,951,343 * 9/1999 Nanami et al. ..... 440/88
5,964,172 * 10/1999 Ikeda ..... 114/55.57

FOREIGN PATENT DOCUMENTS 06080095 3/1994 (JP) .
6-25438 7/1994 (JP) .
7-55199 12/1995 (JP) .
08207887 8/1996 (JP) .

* cited by examiner

*Primary Examiner*—S. Joseph Morano
*Assistant Examiner*—Andrew Wright
(74) *Attorney, Agent, or Firm*—Marshall, O'Toole, Gerstein, Murray & Borun

(57) ABSTRACT

Provided is an oil feeding structure of a personal watercraft capable of enhancing the appearance design of the personal watercraft and of readily letting air out of a tank during oil feeding, thereby smoothly feeding oil. A surface 15 inclined outward and downward is formed on both sides of the highest portion on a deck 2, that is, a portion between a housing portion B for a storage box 11 and a housing portion S for a steering mechanism. Oil feeding ports 9 and 10 are formed on the inclined surfaces, respectively. First and second oil feeding pipe members 17 and 18 are arranged downward in a substantially vertical direction from the oil feeding ports 9 and 10, and are connected to a fuel tank 7 and a lubricating oil tank 8 substantially rectilinearly, respectively.

16 Claims, 8 Drawing Sheets

OIL FEEDING STRUCTURE OF PERSONAL WATERCRAFT

BACKGROUND OF THE INVENTION

1. Field of the Invention

The present invention relates to a personal watercraft. More particularly, the present invention relates to an oil feeding structure formed on a deck for feeding oil to a fuel tank provided in the personal watercraft.

2. Description of the Related Art

Many personal watercrafts have a structure in which an engine is provided in a central portion of the personal watercraft, a propulsion mechanism and an exhaust mechanism such as a propeller shaft, an impeller, a nozzle and the like are provided behind the engine, and a fuel tank and a lubricating oil tank are provided ahead of the engine. As a result, the fuel tank and the lubricating oil tank are positioned slightly ahead of a portion just below a steering mechanism including a steering handlebar. FIG. 6 is a perspective view showing a conventional personal watercraft. FIG. 7 is a exploded perspective view showing a deck, a hatch cover and a deck cover of the personal watercraft of FIG. 6. FIG. 8 is a cross sectional view taken on line VIII—VIII in FIG. 6.

As shown in FIGS. 6 and 7, a deck 52 of a personal watercraft 51 has an opening 53 formed in a front portion of an upper surface 52*a* thereof. The opening 53 serves to house a storage box 64 therein. In order to cover the opening 53, an openable hatch cover 54 is provided. A deck cover 56 is provided between a steering handlebar 55 and the cover 54. A seat 57 where a driver and a fellow passenger are to sit astride is fixed to a central portion of the deck 52 behind the deck cover 56. A flat deck floor 59 for enabling the driver and the fellow passenger to put their feet thereon is formed on both sides of and below a seat fixing portion 58 on the deck 52. An oil feeding port 61 is formed on the side of a portion 60 in the deck 52 where the hatch cover 54 is to be provided. An arrow F in FIG. 7 indicates a forward direction of the personal watercraft 51.

As shown in FIGS. 6 and 8, an oil feeding pipe member 63 for feeding fuel into a fuel tank 62 is connected from the oil feeding port 61 to the fuel tank 62 provided behind and below the oil feeding port 61. The fuel tank 62 is provided behind the storage box 64. Recently, a storage box B is required to be larger. Therefore, a space where the fuel tank 62 is to be provided is restricted.

As shown in FIGS. 6 and 7, the upper surface 52*a* of the deck 52 is formed comparatively flatly. In order to enhance appearance design and to decrease an air resistance when running, the deck cover 56 is inclined upward from a front end thereof to a steering handlebar 55 portion on a rear end thereof. Accordingly, when the deck cover 56 is fixed, a space is formed between the upper surface 52*a* of the deck 52 and a lower surface of the deck cover 56 (see FIG. 8). Japanese Utility Model Publications Nos. Hei 6-25438 and Hei 7-55199 have disclosed the related arts as mentioned above.

In the conventional personal watercraft, the fuel tank 62 needs to be provided further rearward because the large-sized storage box is introduced as described above. Accordingly, if a position where the oil feeding port 61 is to be provided is taken onto the side of the hatch cover 54 in the deck 52, the distance between the oil feeding port 61 and the fuel tank 62 is increased. As a result, it is necessary to incline the oil feeding pipe member 63 from the oil feeding port 61 to the fuel tank 62 (see FIG. 8) and to extend the oil feeding pipe member 63 backwardly in a horizontal direction in the personal watercraft (see FIG. 6). Consequently, the effects of letting air out of the fuel tank 62 are deteriorated and an oil feeding speed is also reduced when the fuel is fed to the fuel tank.

If the oil feeding port 61 is to be provided further behind the above-mentioned position on the surface of the deck 52, the oil feeding port 61 is positioned in the vicinity of the deck floor 59. Thus, it becomes difficult to determine an appropriate position for the oil feeding port 61.

SUMMARY OF THE INVENTION

In order to solve the above-mentioned problems, it is an object of the present invention to provide an oil feeding structure capable of easily performing an oil feeding work without damaging the appearance design of a personal watercraft. The oil feeding work means the working of feeding fuel and lubricating oil.

The present invention provides an oil feeding structure of a personal watercraft having a steering handlebar, a fuel tank provided in the personal watercraft and an openable hatch cover provided on an upper surface of a deck, comprising a first oil feeding port for feeding fuel to the fuel tank being formed in a portion of the deck, the portion being located in front of and close to the steering handlebar, the first oil feeding port being covered with the hatch cover which is shut off.

According to such a structure, the first oil feeding port is hidden by the hatch cover. Therefore, the appearance design of the personal watercraft is enhanced. Furthermore, the portion of the deck in front of and close to the steering handlebar is a high portion on the deck, since the front portion of the deck is generally inclined rearward and upward. Thus, the first oil feeding port is formed in the high portion. In addition, the first oil feeding port approaches and is closer to the fuel tank so that fuel can be fed smoothly.

The present invention provides another oil feeding structure of a personal watercraft having a fuel tank provided in the personal watercraft and an openable hatch cover provided on an upper surface of a deck, comprising an first oil feeding port for feeding fuel to the fuel tank being formed in a portion on the deck, the portion being located above the fuel tank, the first oil feeding port being covered with the hatch cover which is shut off.

According to such a structure, the first oil feeding port is hidden by the hatch cover. Consequently, the appearance design is enhanced. In addition, the fuel can be fed from directly above the tank, and the fuel feeding path is shortened. Therefore, the fuel oil can be fed smoothly.

The deck is formed to swell out upward in such a manner that a vicinity of a portion provided with the first oil feeding port is to be located at the top of the upper surface of the deck. Consequently, the first oil feeding port can be provided in a high position, and it is possible to keep an almost rectilinear fuel feeding path from the first oil feeding port to the fuel tank. Therefore, air can be readily let out of the tank so that the oil can be fed smoothly.

Furthermore, surfaces positioned on both sides of the top provided on the upper surface of the deck are inclined, one of the inclined surfaces being provided with the first oil feeding port for feeding fuel to a fuel tank, and the other inclined surface being provided with a second oil feeding port for feeding lubricating oil to a lubricating oil tank. Consequently, the two oil feeding ports necessary for the personal watercraft can be provided efficiently. More specifically, each oil feeding port is provided on each inclined surface. Therefore, although the portion is easily subjected to restriction on a space, it is possible to keep a sufficient surface where each oil feeding port is to be provided.

In addition, a cap is provided on the first oil feeding port. The cap includes a shut-off member for shutting off the first oil feeding port. A guide drum member projects onto the shut-off member for being inserted into the first oil feeding port to guide the cap. Consequently, the cap can easily be attached to the first oil feeding port.

These objects as well as other objects, features and advantages of the present invention will become more apparent to those skilled in the art from the following description with reference to the accompanying drawings.

BRIEF DESCRIPTION OF THE DRAWINGS

FIG. 5B is a sectional exploded view showing the cap in FIG. 5A, a mouth piece defining an oil feeding port and the like;

DESCRIPTION OF THE PREFERRED EMBODIMENTS

An oil feeding structure according to an embodiment of the present invention will be described below with reference to the accompanying drawings.

Figure 1:
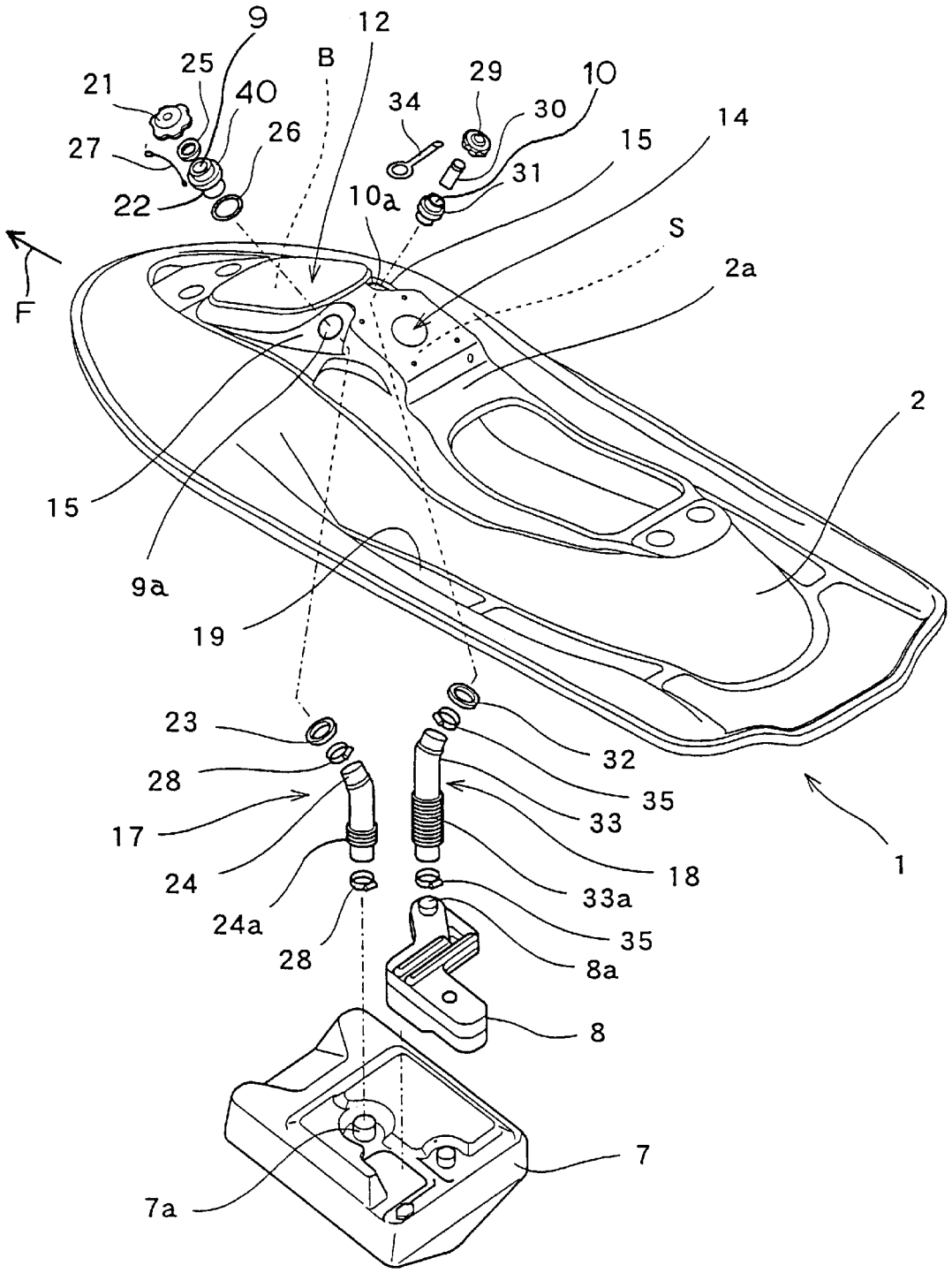
FIG. 1 is a perspective view showing a deck of a personal watercraft to which an oil feeding structure according to an embodiment of the present invention is applied.
Figure 2A:
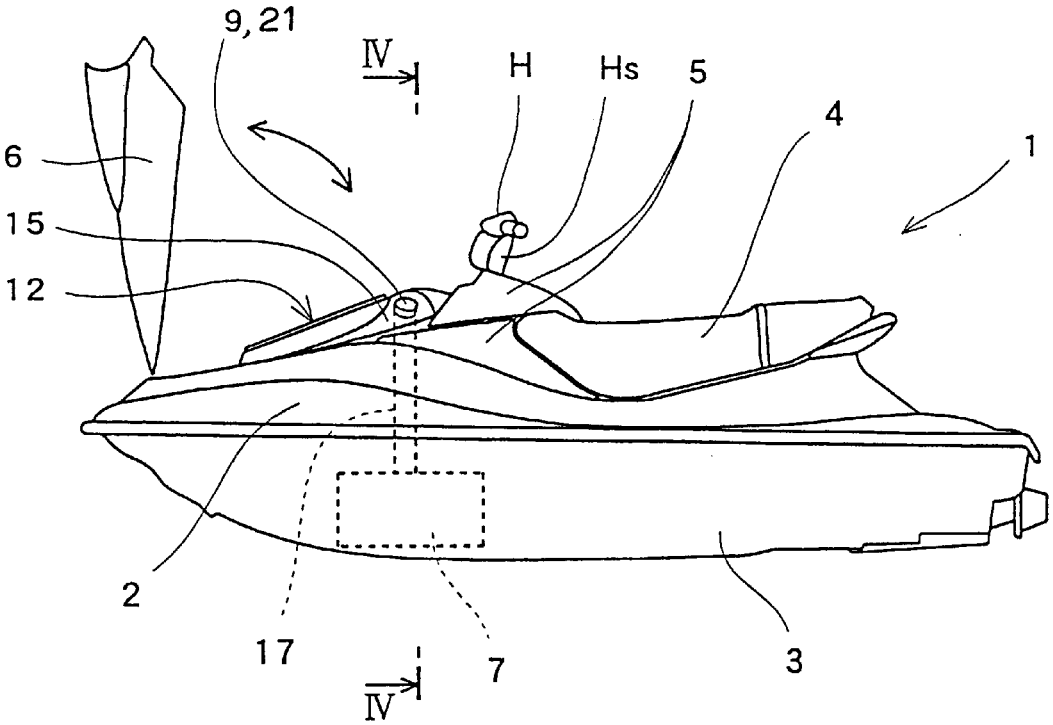
FIG. 2A is a side view showing the personal watercraft of FIG. 1.
Figure 2B:
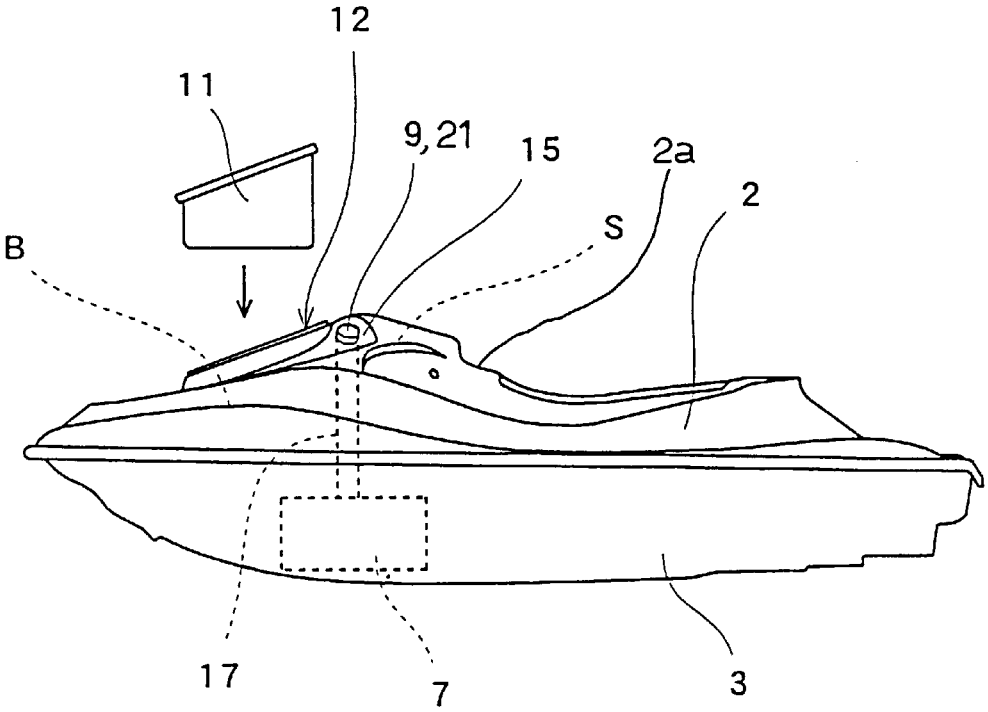
FIG. 2B is a side view showing the personal watercraft in which a hatch cover, a deck cover and a seat are removed.
Figure 3:
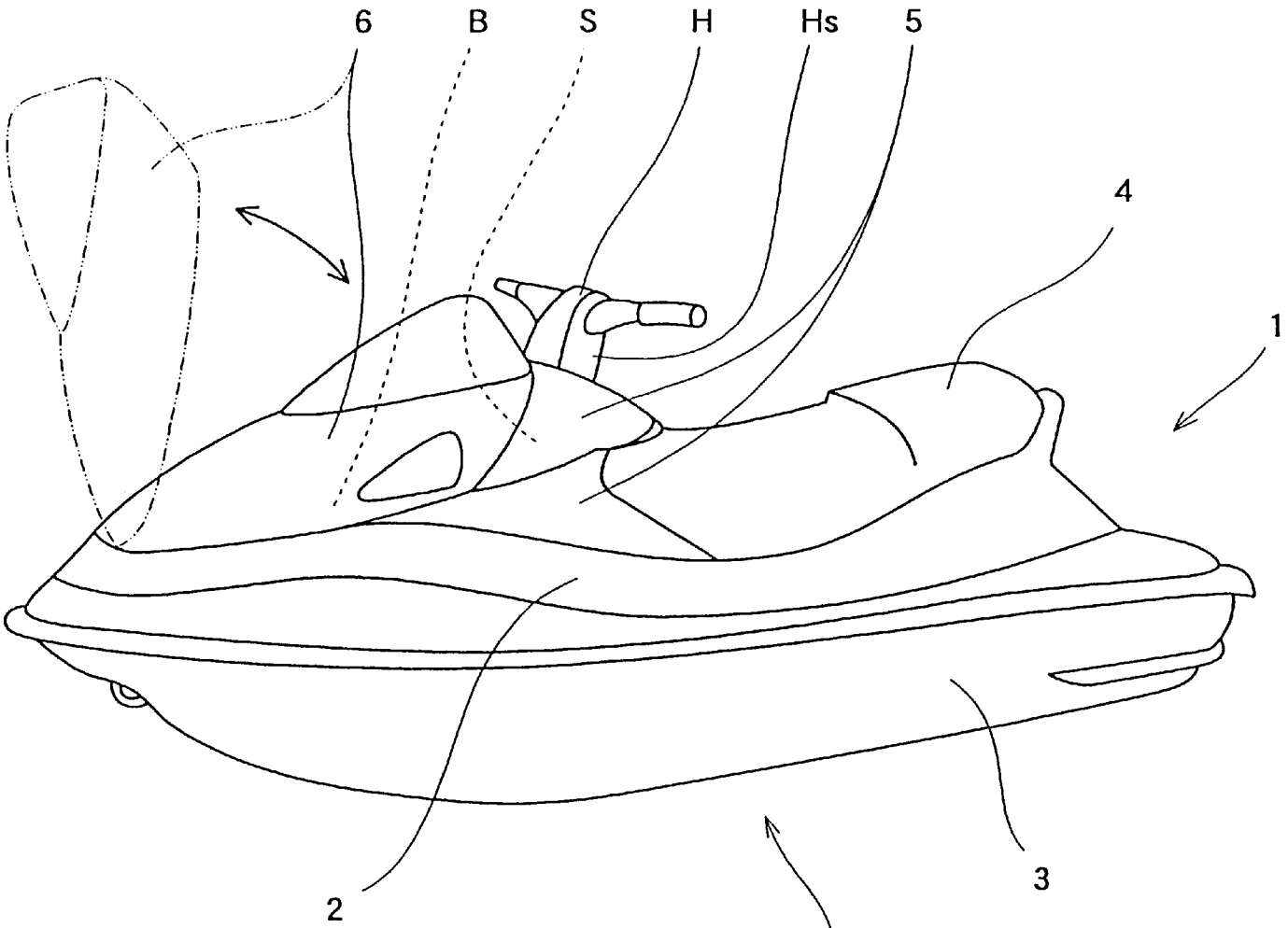
FIG. 3 is a perspective view showing the personal watercraft of FIG. 2A.

As shown in FIGS. 1, 2 and 3, a personal watercraft 1 is formed by a deck 2 provided in an upper portion and a hull 3 provided in a lower portion. A seat 4 where a driver and a fellow passenger are to sit astride is fixed to an upper surface 2*a* of the deck 2. A deck cover 5 is fixedly provided on the upper surface 2*a* of the deck 2. A hatch cover 6 is attached to the upper surface 2*a* of the deck 2 with a front end thereof openable through a hinge (not shown). The reference numeral H denotes a steering handlebar. As shown, the hatch cover 6 is provided from a vicinity of a front end of the personal watercraft 1 to a portion positioned immediately before the steering handlebar H, and has a larger size than a hatch cover for simply covering a storage box in a conventional personal watercraft.

A fuel tank 7 and a lubricating oil tank 8 are provided in the personal watercraft 1 slightly ahead of a portion positioned just below the steering handlebar H. The lubricating oil tank 8 has a smaller size than the fuel tank 7, and is provided on an upper surface of the fuel tank 7. A first oil feeding port 9 for feeding fuel to the fuel tank 7 and a second oil feeding port 10 for feeding lubricating oil to the lubricating oil tank 8 are provided above the fuel tank 7 in the deck 2.

As shown in FIG. 2A, when the hatch cover 6 is opened, an opening 12 formed on the deck 2 for fitting a storage box 11 therein and for inspecting the inside of the deck 2, a cap 21 shutting off the first oil feeding port 9 and a cap 29 shutting off the second oil feeding port 10 are exposed (see FIG. 1 together). Thus, the cap 21 with the oil feeding port 9 and the cap 29 with the oil feeding port 10 are usually hidden by the hatch cover 6 (see FIG. 3). Therefore, the appearance design of the personal watercraft 1 is enhanced.

FIG. 1 shows the deck 2 in more detail. An arrow F shows a forward direction. The upper surface 2*a* of the deck 2 is inclined upward and rearward from a front end of a portion where the opening 12 is formed, and is provided in such a manner that the highest portion is positioned in the vicinity of a rear end of the opening 12. A portion on the upper surface 2*a* of the deck 2 which forms a hole 14 for enabling a shaft (indicated as the reference numeral Hs in FIG. 2A) of the steering handlebar H to penetrate therethrough is inclined rearward and downward. More specifically, as shown in FIG. 2, the deck 2 has a curved shape to swell out upward in such a manner that a portion between a housing portion B for the storage box 11 and a housing portion S for a steering mechanism becomes a top thereof. As a result, the upper shape (FIG. 2B) of the deck 2 which is provided ahead of the seat 4 in FIG. 2 almost conforms to the upper shape of the appearance of the water craft (FIG. 2A) obtained after the deck cover 5 and the hatch cover 6 are fixed. In other words, the upper surface 2*a* of the deck 2 approaches the deck cover 5 and the hatch cover 6, and a large space is not provided between the upper surface 2*a* of the deck 2.

Figure 4:
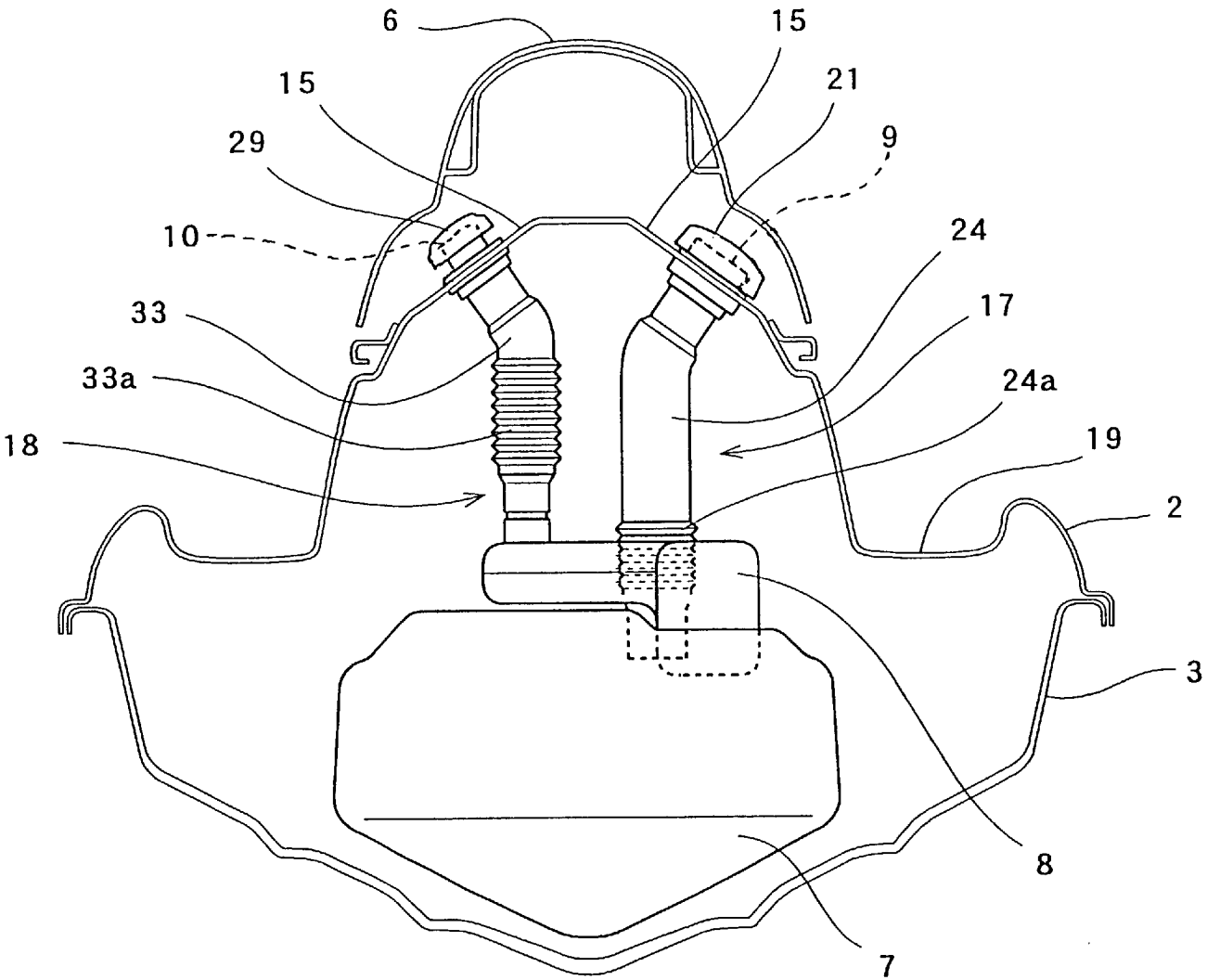
FIG. 4 is a sectional view taken along the line IV—IV in FIG. 2A.

An inclined surface 15 inclined outward and downward is formed on both sides of the above-mentioned top portion which is the portion between the housing portion B and the housing portion S. The oil feeding ports 9 and 10 are formed on the inclined surfaces 15, respectively. Accordingly, the oil feeding ports 9 and 10 are provided in very high portions on the upper surface 2*a* of the deck 2. In addition, the portion between the housing portion B for the storage box 11 and the housing portion S for the steering mechanism is positioned substantially directly above and aligned with the fuel tank in the personal watercraft. Accordingly, a first oil feeding pipe 24 and a second oil feeding pipe 33 which are to be connected from the oil feeding ports 9 and 10 to the tanks 7 and 8 respectively are arranged downward in a substantially vertical direction as shown in FIGS. 2 and 4. In addition, the oil feeding pipe 24 and 33 can be shortened to be substantially rectilinearly. Therefore, air can be readily let out of the tanks 7 and 8 so that the fuel and the lubricating oil can be smoothly gravity fed to the tanks 7 and 8.

The portions on the upper surface 2*a* of the deck 2 where the oil feeding ports 9 and 10 are to be formed are inclined as described above corresponding to restriction on a space, although such portion are not necessary to be inclined surfaces. According to the space in the portions where the oil feeding ports are to be formed or the design of the deck 2, the surfaces where the oil feeding ports 9 and 10 are to be formed may be vertical or horizontal surfaces, for example. In brief, it is preferable that the oil feeding ports 9 and 10 should be formed in the high portions on the upper surface 2*a* of the deck 2. From such a viewpoint, the deck 2 and the oil feeding ports 9 and 10 are formed. In this embodiment, the upper surface 2*a* of the deck 2 is caused to conform to the upper shape of the appearance of the personal watercraft as much as possible. By the above mentioned construction, the portion (between the housing portion B for the storage box 11 and the housing portion S for the steering mechanism) is located at the top of the upper surface 2*a* of the deck 2, and is further provided above the tanks 7 and 8 as shown in FIGS. 2A and 2B.

In FIG. 1, the reference numeral 19 denotes a deck floor which is formed low and flatly for causing the driver and the fellow passenger to put their feet thereon.

A first oil feeding pipe member 17 for fuel includes, as components, a cap 21, a mouth piece 22 (it may be called an oil filler neck), a fixing nut 23, an oil feeding pipe 24 and the like as shown in FIG. 1. The mouth piece 22 defines the oil feeding port 9. The reference numeral 25 denotes a seal ring to be attached to the cap 21. The reference numeral 26 denotes a gasket to be provided between a flange portion 40 of the mouth piece 22 and a peripheral edge of a bore 9*a* for attaching the mouth piece 22 formed on the deck 2. The reference numeral 27 denotes a chain for fixing the cap 21 to the mouth piece 22. The reference numeral 28 denotes a clamp for fixedly connecting an upper end of the oil feeding pipe 24 to the mouth piece 22, and for fixedly connecting a lower end to an inlet 7*a* of the fuel tank 7. The oil feeding pipe 24 is provided with a bellows portion 24*a* for enhancing the degree of freedom of piping.

A second oil feeding pipe member 18 for lubricating oil includes, as components, a cap 29, a filter 30, a mouth piece 31, a fixing nut 32, an oil feeding pipe 33 and the like as shown in FIG. 1. The mouth piece 31 defines the oil feeding port 10. The reference numeral 34 denotes a belt for attaching the cap 29 to the mouth piece 31. The reference numeral 35 denotes a clamp for fixedly connecting an upper end of the oil feeding pipe 33 to the mouth piece 31, and for fixedly connecting a lower end to an inlet 8*a* of the lubricating oil tank 8. The oil feeding pipe 33 is provided with a bellows portion 33*a* for enhancing the degree of freedom of piping. The reference 10*a* (shown in FIG. 1) denotes a bore for attaching the mouth piece 22.

Figure 5A:
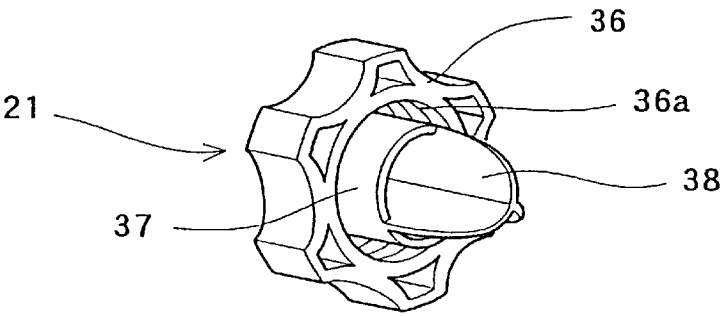
FIG. 5A is a perspective view showing a cap shutting off an oil feeding port in the oil feeding structure of FIG. 1
Figure 5B:
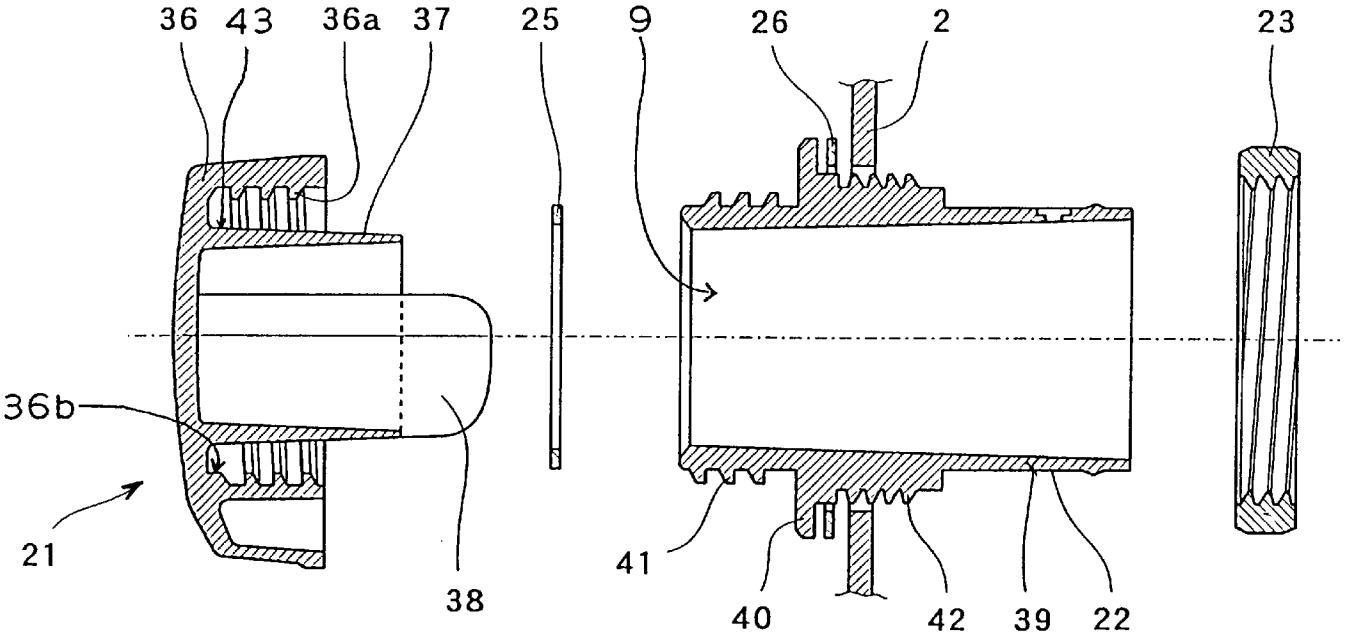
Figure 6:
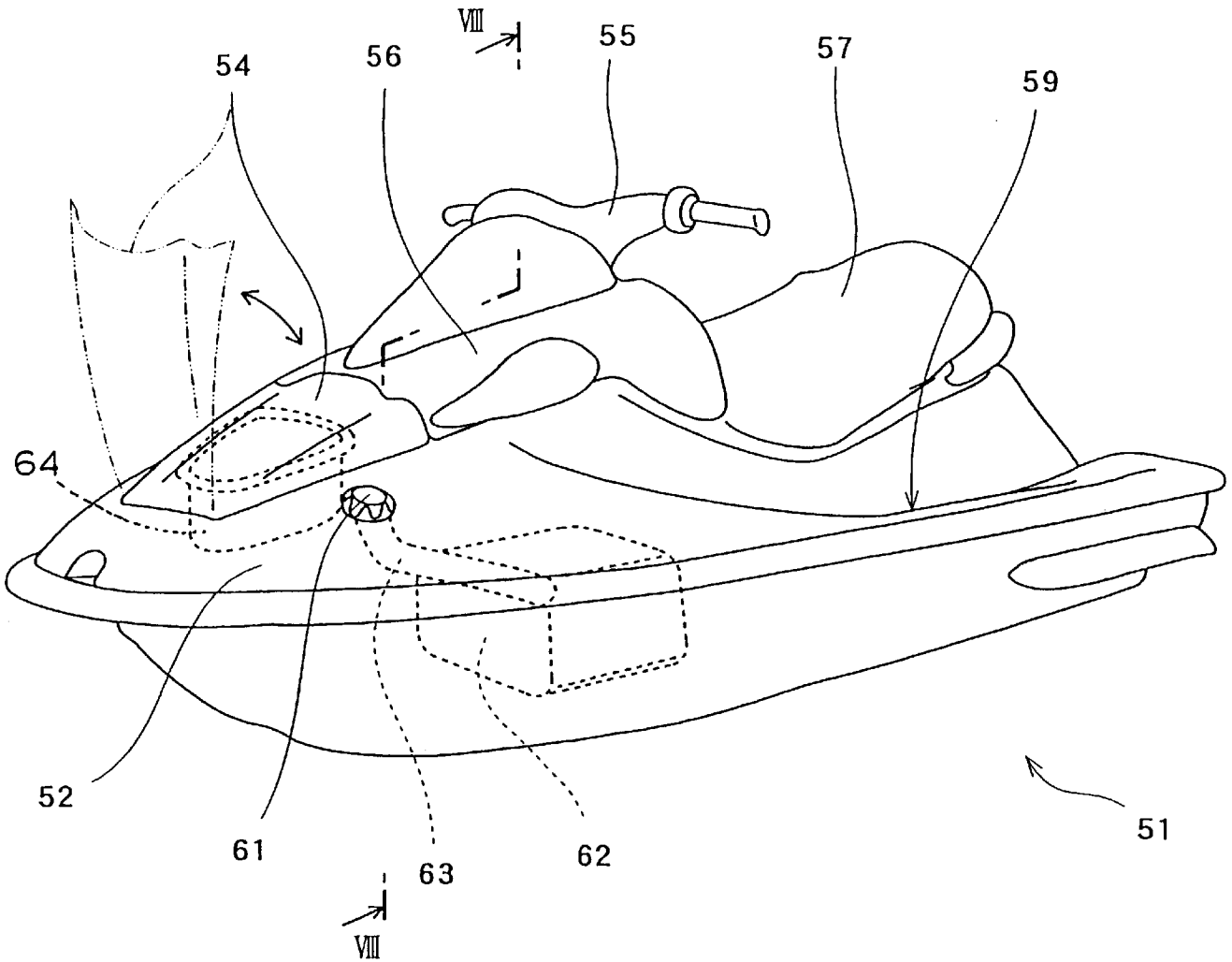
FIG. 6 PRIOR ART
FIG. 6 is a perspective view showing a personal watercraft having an oil feeding structure according to the prior art.
Figure 7:
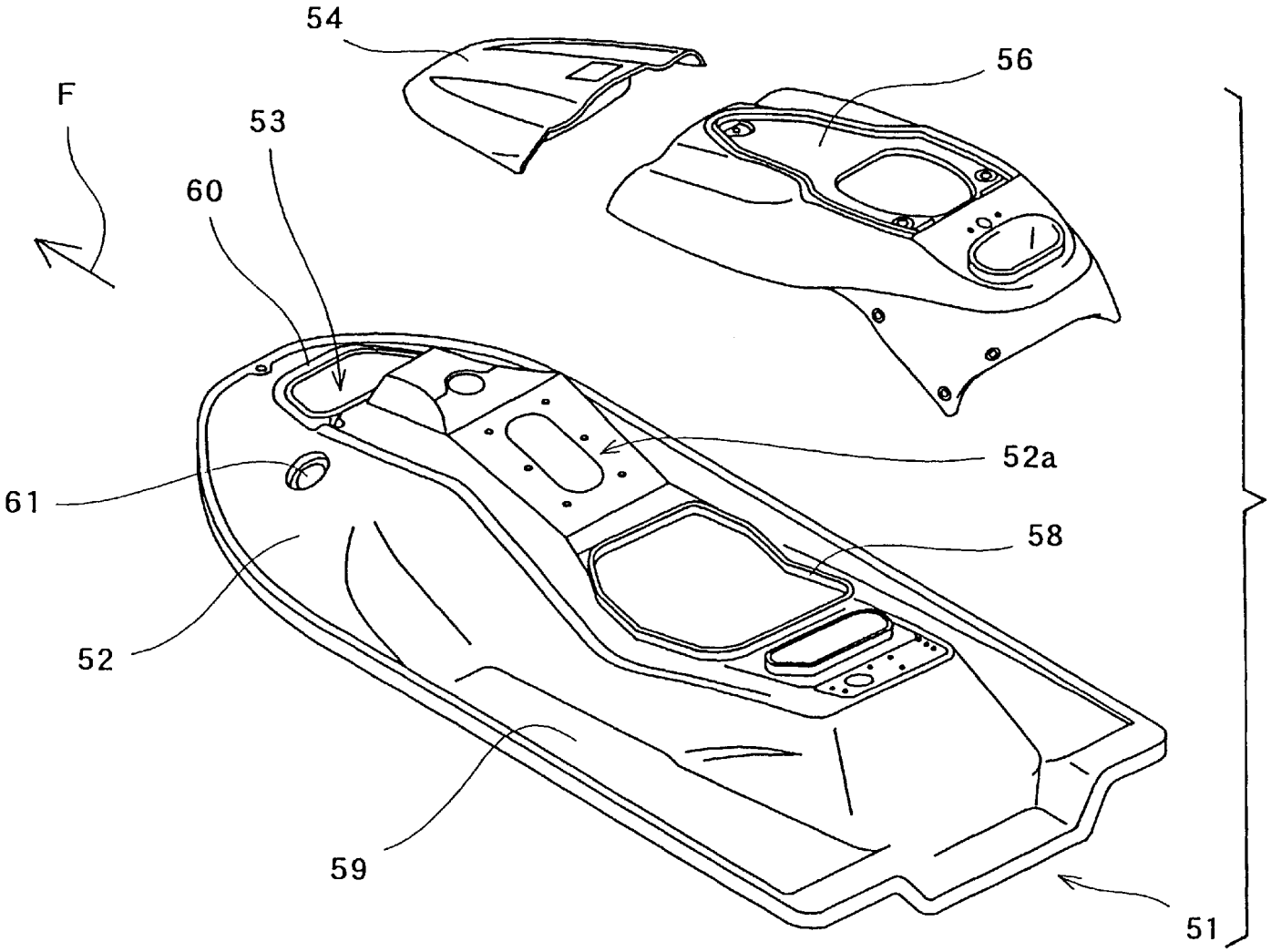
FIG. 7 PRIOR ART
FIG. 7 is a perspective exploded view showing a deck, a hatch cover and deck cover in the prior art personal watercraft of FIG. 6.
Figure 8:
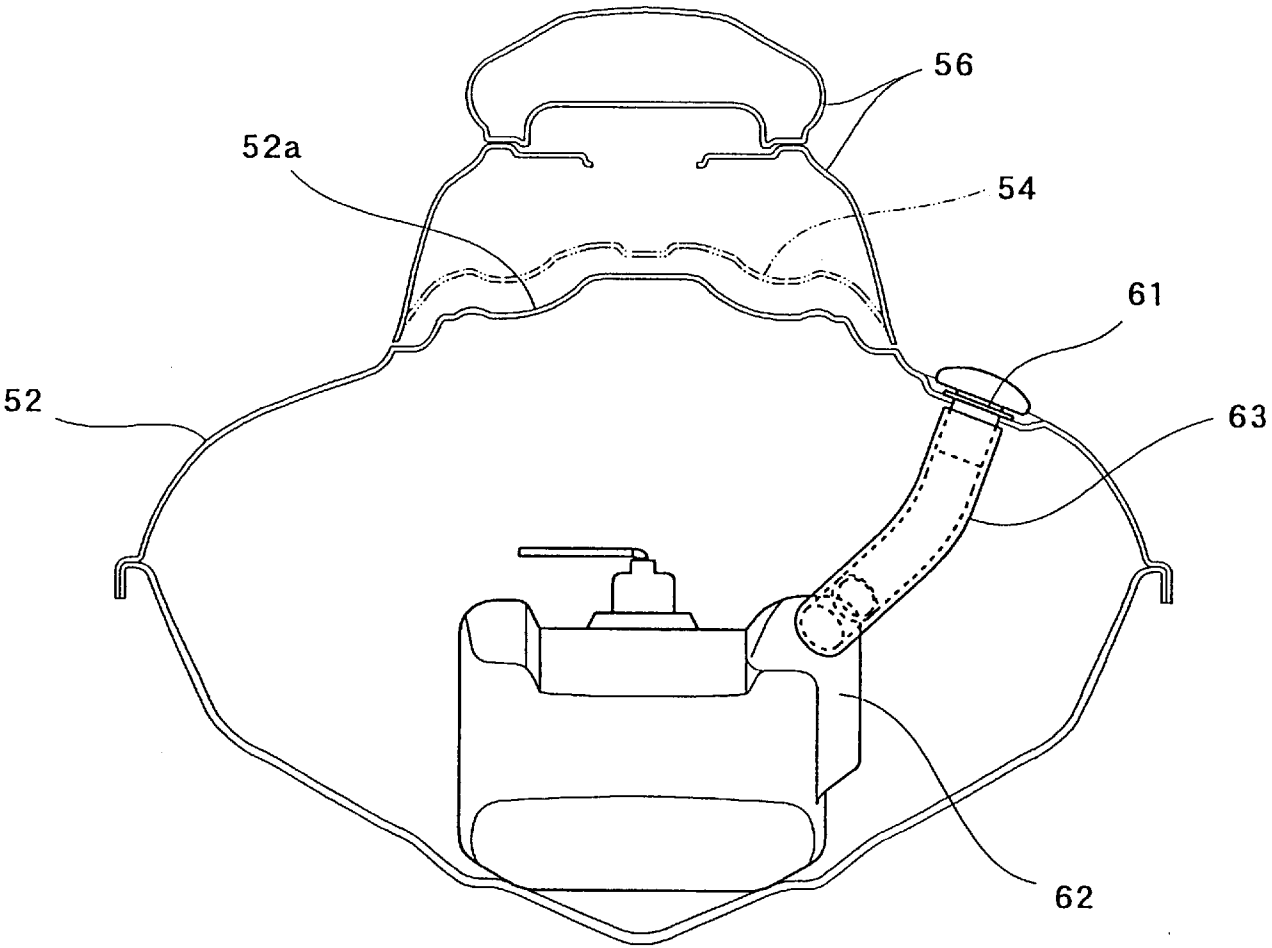
FIG. 8 PRIOR ART
FIG. 8 is a schematic sectional view taken along the line VIII—VIII in FIG. 6.

FIG. 5 shows, in detail, the cap 21 and the mouth piece 22 which constitute the oil feeding port 9 of the first oil feeding pipe member 17 for fuel. As shown in FIG. 5A, the cap 21 is constituted by a bottomed cylindrical shut-off member 36 having a plurality of recesses formed on an outer peripheral surface thereof and a female screw 36*a* formed on an inner peripheral surface thereof, a cylindrical guide drum 37 coaxially erected on the inside of the shut-off member 36, and three guide ribs 38 extend from the guide drum 37 along the direction of an axis of the cap 21. The guide drum 37 and the guide rib 38 serve to smoothly guide the cap 21 to the oil feeding port 9 by causing the guide drum 37 and the guide rib 38 to penetrate into the oil feeding port 9 of the mouth piece 22 when the cap 21 is to be screwed into the mouth piece 22. The seal ring 25 is attached between the inside face 36*b* of the shut-off member 36 of the cap 21 and the outside face 43 of the guide drum 37. The mouth piece 22 shown in FIG. 5B is constituted by a cylindrical body 39, the oil feeding port 9 defined with the inside of the body 39, the flange portion 40 formed on an outer peripheral surface of the body 39, an upper male screw 41 threaded above the flange portion 40 on the outer peripheral surface of the body 39, and a lower male screw 42 threaded below the flange portion 40 on the outer peripheral surface of the body 39. The upper male screw 41 is screwed into the female screw 36*a* of the cap 21. The lower male screw 42 is a portion where the fixing nut 23 is to be screwed so as to interpose the peripheral edge of the bore 9*a* for attaching the mouth piece 22 formed on the deck 2 with the flange portion 40 through the gasket 26 when the mouth piece 22 is attached to the deck 2 (see FIG. 1).

Since the cap 29, the mouth piece 31 and the fixing nut 32 in the oil feeding pipe member 18 for lubricating oil shown in FIGS. 1 and 4 can also be coupled to each other with the same structure as the cap 21, the mouth piece 22 and the fixing nut 23 in the oil feeding pipe member 17 for fuel shown in FIG. 5B, description will be omitted.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

a hull having a deck;

a steering handlebar;

a fuel tank provided in the hull;

an openable hatch cover provided on an upper surface of the deck;

a fuel feeding port provided on the upper surface of of the deck; and a fuel feeding pipe provided from the fuel feeding port to the fuel tank, wherein the fuel feeding port is located above the fuel tank and located in front of and close to the steering handlebar, and the fuel feeding port is covered with the hatch cover when the hatch cover is closed.

2. The personal watercraft according to claim 1, further comprising a storage box provided in front of the fuel feeding port of the deck, the storage box being covered with the hatch cover when the hatch cover is closed.

3. The personal watercraft according to claim 1, wherein the fuel feeding port is located near an uppermost point of the upper surface of the deck.

4. The personal watercraft according to claim 1, further comprising a cap provided on the fuel feeding port, said cap including a shut-off member for shutting off the fuel feeding port, and a guide member for being inserted into the fuel feeding port to guide the cap.

5. A personal watercraft comprising:

a hull having a deck;

a steering handlebar;

a fuel tank provided in the hull;

an openable hatch cover provided on an upper surface of the deck;

a first oil feeding port for feeding fuel to the fuel tank being formed in a portion of the deck, said portion being located in front of and close to the steering handlebar;

said first oil feeding port being covered with the hatch cover when the hatch cover is closed;

the first oil feeding port is located near an uppermost point of the upper surface of the deck;

a lubricating oil tank provided in the hull;

the upper surface of the deck including two inclined surfaces, one of the inclined surfaces being provided with the first oil feeding port for feeding fuel to the fuel tank, and the other inclined surface being provided with a second oil feeding port for feeding lubricating oil to the lubricating oil tank.

6. The personal watercraft according to claim 5, wherein the first oil feeding port and the second oil feeding port are provided above the fuel tank and the lubricating oil tank, respectively.

7. A personal watercraft comprising:

a hull having a deck;

a steering handlebar;

a fuel tank and a lubricating oil tank provided in the hull;

an openable hatch cover provided on an upper surface of the deck; and a fuel feeding port and a lubricating oil feeding port provided on the upper face of the deck;

wherein the fuel feeding port and the lubricating oil feeding port are located in front of and close to the steering handlebar, and the fuel feeding port and the lubricating oil feeding port are covered with the hatch cover when the hatch cover is closed.

8. The personal watercraft of claim 7, wherein the fuel feeding port and the lubricating oil feeding port are located above the fuel tank and the lubricating oil tank, respectively.

9. The personal watercraft of claim 8, further comprising a storage box provided in front of the fuel feeding port and the lubricating oil feeding port of the deck, the storage box being covered with the hatch cover when the hatch cover is closed.

10. The personal watercraft of claim 8, further comprising a fuel feeding pipe provided from the fuel feeding port to the fuel tank and a lubricating oil feeding pipe provided from the lubricating oil feeding port to the lubricating oil tank.

11. The personal watercraft of claim 8, wherein the oil feeding port and the lubricating oil feeding port are located near an uppermost point of the upper surface of the deck.

12. The personal watercraft of claim 11, wherein the upper surface of the deck includes two inclined surfaces, one of the inclined surfaces being provided with the fuel feeding port and the other inclined surface being provided with the lubricating oil feeding port.

13. The personal watercraft of claim 7, further comprising a storage box provided in front of the fuel feeding port and the lubricating oil feeding port of the deck, the storage box being covered with the hatch cover when the hatch cover is closed.

14. The personal watercraft of claim 7, wherein the fuel feeding port and the lubricating oil feeding port are located near an uppermost point of the upper surface of the deck.

15. The personal watercraft of claim 14, wherein the upper surface of the deck includes two inclined surfaces, one of the inclined surfaces being provided with the fuel feeding port and the other inclined surface being provided with the lubricating oil feeding port.

16. The personal watercraft of claim 7, further comprising a fuel feeding pipe provided from the fuel feeding port to the fuel tank and a lubricating oil feeding pipe provided from the lubricating oil feeding port to the lubricating oil tank.

* * * * *